US005313883A

United States Patent [19]

DiGenova

[11] Patent Number: 5,313,883

[45] Date of Patent: May 24, 1994

[54] PRINTING PRESS WITH A DYNAMIC EXPANSION BAND ADJUSTING MECHANISM

[75] Inventor: Phillip D. DiGenova, Hinsdale, Ill.

[73] Assignee: Rockwell International Corporation, ElSegundo, Calif.

[21] Appl. No.: 48,341

[22] Filed: Apr. 15, 1993

[51] Int. Cl.[5] ..... B41F 13/24

[52] U.S. Cl. ..... 101/247; 101/378; 492/21; 492/28

[58] Field of Search ..... 101/247, 127.1, 375, 101/378, 216, 219, 415.1; 492/21, 28, 38; 270/45, 47; 493/476

[56] References Cited

U.S. PATENT DOCUMENTS

| | | | |
|---|---|---|---|
| 2,555,267 | 5/1951 | Crafts | 270/47 |
| 3,477,709 | 11/1969 | Neal et al. | 270/47 |
| 3,783,780 | 1/1974 | Saueressig | 101/216 |
| 4,044,669 | 8/1977 | Luther | 101/127.1 |
| 4,150,622 | 4/1979 | Stollenwerk | 101/378 |
| 4,805,502 | 2/1989 | Ishigure | 493/475 |
| 4,936,561 | 6/1990 | Mukai | 270/45 |
| 5,036,765 | 8/1991 | Keilhau | 101/219 |
| 5,168,808 | 12/1992 | Prem et al. | 101/375 |

FOREIGN PATENT DOCUMENTS 64-2977 7/1989 Japan .

*Primary Examiner*—Eugene H. Eickholt

*Attorney, Agent, or Firm*—C. B. Patti; H. F. Hamann

[57] ABSTRACT

A self-locking mechanism (10) for selectively dynamically adjusting expansion bands (12) of a running cylinder (11) of a rotary printing press during rotation includes a cylindrical adjustment member (30, 72) with a diameter substantially the same as the diameter of the running cylinder which engages a band box (22, 80) rotating with the running cylinder (11) to make the selected adjustments in response to rotation of cylindrical adjusting member (30, 72) at a speed different from the speed of the running cylinder (11). The speed difference is produced by a differential (52, 75) stationary with respect to the running cylinder (11) which engages the cylindrical member (30, 72) and the running cylinder (11). The cylindrical adjusting member (30, 72) is mounted to the running cylinder (11) on an interrupted journal (35). The cylindrical adjusting member (30) has an inner engagement surface (38) for engagement with the band box (22) and another engagement surface (39) for engagement with the differential. In another embodiment, the cylindrical adjusting member (72) has a side engagement surface (78) for engaging the band box (80) and another engagement surface (83) for engaging the differential.

47 Claims, 6 Drawing Sheets

PRINTING PRESS WITH A DYNAMIC EXPANSION BAND ADJUSTING MECHANISM

BACKGROUND OF THE INVENTION

1. Field of the Invention

This invention generally relates to running cylinders of a rotary printing press and, specifically, to an apparatus for adjusting expansion bands on the running cylinder to change its effective diameter while the running cylinder is rotating.

2. Description of the Related Art Including Information Disclosed Under 37 CFR 1.97–1.99

Rotary printing presses employ numerous running cylinders. It is well known to provide these running cylinders with adjustable expansion bands in order to slightly increase or decrease the effective diameter of the cylinder. A folder of a rotary press folds the assembled webs of paper, cuts the webs into a product and then folds the product. The correct draw through the folder for a full range of thickness of product and minimization of "dog ears" and paper tears are achieved in the running cylinder of the folder, or folding cylinder, through provision of several sets expansion bands.

In some known presses, it is necessary to stop the press and adjust the expansion bands only after the running cylinder has stopped rotating which disadvantageously interrupts the production of printed product. The folding cylinder is provided with a band box for adjusting the expansion bands mounted to an end of the folding cylinder at a working area location within a peripheral annular band encompassing the outer third of the radius of the folding cylinder. The band box, being carried by the folding cylinder in the working area, revolves around the axis of rotation of the running cylinder and is therefore not accessible for making the manual adjustments while the running cylinder is rotating during operation of the press. In addition, the presence of large mechanisms in the working area, including a plurality of band adjustment studs and pin lever shafts and their associated cam followers and actuators and other obstacles, makes it impossible to access the band box from the end of the cylinder during rotation. Accordingly, in these known units, an operator uses a wrench to manually turn an adjustment shaft on the band box to move the expansion bands only after the folding cylinder is brought to a complete stop.

A complicated dynamic mechanism, shown in U.S. Pat. No. 4,936,516 of Mukai issued Jun. 26, 1990 is disadvantageously located in the working area. This mechanism utilizes two sun gears mounted on a plain bearing of the folding cylinder journal and a pin cam and its bearings mounted to a hub of the sun gear. However, the additive accumulation, or stack up, of tolerances and operational forces of this mechanism is deleterious to long life of the operating components and can make adjustment of the sun gear difficult. In addition, in this known Japanese mechanism, it appears that maintenance or replacement of parts disadvantageously requires major disassembly of the cylinder and its complex arrangement of numerous components and reboring of the journal of the running cylinder. Moreover, it appears that the known Japanese mechanism is not suitable for retrofitting to an existing folding cylinder.

Another problem with the dynamic expansion band adjustment mechanism is that once the adjustment is made, affirmative action must be taken to lock the adjustment in place. If such affirmative locking action is inadvertently not taken by the operator, then the selected adjustment will be altered during operation of the press by forces executed by the work product on the expansion bands.

SUMMARY OF THE INVENTION

It is therefore the principal object of the present invention to provide a printing press with a dynamic expansion band adjustment mechanism that enables dynamic adjustment of the expansion bands while overcoming the problems with the known expansion band adjustment mechanism noted above.

This object is achieved by provision of a printing press, having a running cylinder with a rotary axis, an outer surface with an outer diameter and expansion bands for changing the effective outer diameter of the running cylinder, and with a dynamic expansion band adjustment mechanism for moving the expansion bands while the running cylinder is rotating about the rotary axis. This dynamic expansion band adjustment mechanism comprises a cylindrical adjusting member having an inner surface with an inner diameter and an outer surface with an outer diameter mounted to the running cylinder for rotation about the rotary axis of the running cylinder, the inner diameter of the cylindrical adjusting member being substantially the same as the outer diameter of the running cylinder, means mounted to the running cylinder at a location within the inner diameter of the cylindrical adjusting member for adjusting the expansion bands in response to relative rotary movement between the cylindrical adjusting member and the running cylinder and means including a member located without the outer diameter of the running cylinder and engageable with the outer surface of the cylindrical adjusting member for moving the cylindrical adjusting member about the rotary axis relative to the running cylinder.

Also, the object of the invention is obtained by providing a printing press having a running cylinder rotatable at a preselected speed around a rotary axis and expansion bands for changing the effective outer diameter of the running cylinder, with a dynamic expansion band adjustment mechanism for moving the expansion bands while the running cylinder is rotating about the rotary axis, comprising a cylindrical adjusting member with a first and second engagement surfaces on different sides of the cylindrical adjusting member, means engageable with one of the first and second engagement surfaces for rotating the cylindrical adjusting member, another member having an engagement surface for engagement with the cylindrical adjusting member rotating means, means for driving the other member to rotate at substantially the same speed as the running cylinder, means including a member engaging the other of the first and second engagement surfaces for moving the expansion bands in response to a rotational speed difference between the cylindrical adjusting member and the other member, and means for controlling the cylindrical adjusting member rotating means to produce a rotational speed difference between the cylindrical adjusting member and the other member.

Moreover, the object of the invention is achieved in part by provision of a printing press, having a running cylinder with a rotary axis, a diameter and expansion bands for changing the diameter of the running cylinder, with a dynamic expansion band adjustment mechanism for moving the expansion bands while the running cylinder is rotating about the rotary axis, comprising a cylindrical adjusting member with an inwardly facing engagement surface, means for mounting the cylindrical adjusting member for rotation about the rotary axis of the running cylinder, means rotating with the running cylinder and responsive to relative rotary movement between the cylindrical adjusting member and the running cylinder for moving the expansion bands and means for rotatably moving the cylindrical adjusting member about the rotary axis relative to the running cylinder.

Obtainment of the object is achieved through provision of a printing press, having a running cylinder with a diameter, an axis of rotation and expansion bands for changing the diameter of the running cylinder, with a dynamic expansion band adjustment mechanism for moving the expansion bands while the running cylinder is rotating about the rotary axis, comprising a cylindrical adjusting member having a plurality of engagement surfaces carried on an interrupted journal of the running cylinder for rotation about the axis of rotation of the running cylinder, means for engaging one of the engagement surfaces for rotating the cylindrical adjusting member relative to the running cylinder and means for engaging another one of the engagement surfaces for moving the expansion bands of the running cylinder.

The object of the invention is additionally acquired by provision of a printing press having a running cylinder rotatable at a preselected speed with expansion bands for changing the diameter of the running cylinder, with a dynamic expansion band adjustment mechanism for moving the expansion bands while the running cylinder is rotating about the rotary axis, comprising an apparatus for moving the expansion bands, a cylindrical adjusting member having a plurality of engagement surfaces, a differential engaged with one of the plurality of engagement surfaces, a cylindrical member having an outer engagement surface for engagement with the differential, means for driving the cylindrical member to rotate at a speed substantially equal to the preselected speed of the running cylinder, means for actuating the differential to produce a rotational speed difference between the cylindrical adjusting member and the cylindrical member and means including a member engaged with another one of the plurality of engagement surfaces for moving the expansion bands in response to the rotational speed difference between the cylindrical adjusting member and the cylindrical member.

Still further, the object is the invention is obtained by provision of a printing press having a running cylinder with an outer diameter for rotation about a rotary axis at a preselected speed and expansion bands for changing the effective outer diameter of the running cylinder with a dynamic expansion band adjustment mechanism, comprising means for selectively adjusting the expansion bands while the running cylinder is rotating and means for automatically locking the expansion bands adjustment selected by the selectively adjusting means.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several FIGURES of the drawing, in which.

DETAILED DESCRIPTION OF THE PREFERRED EMBODIMENT

Figure 1:
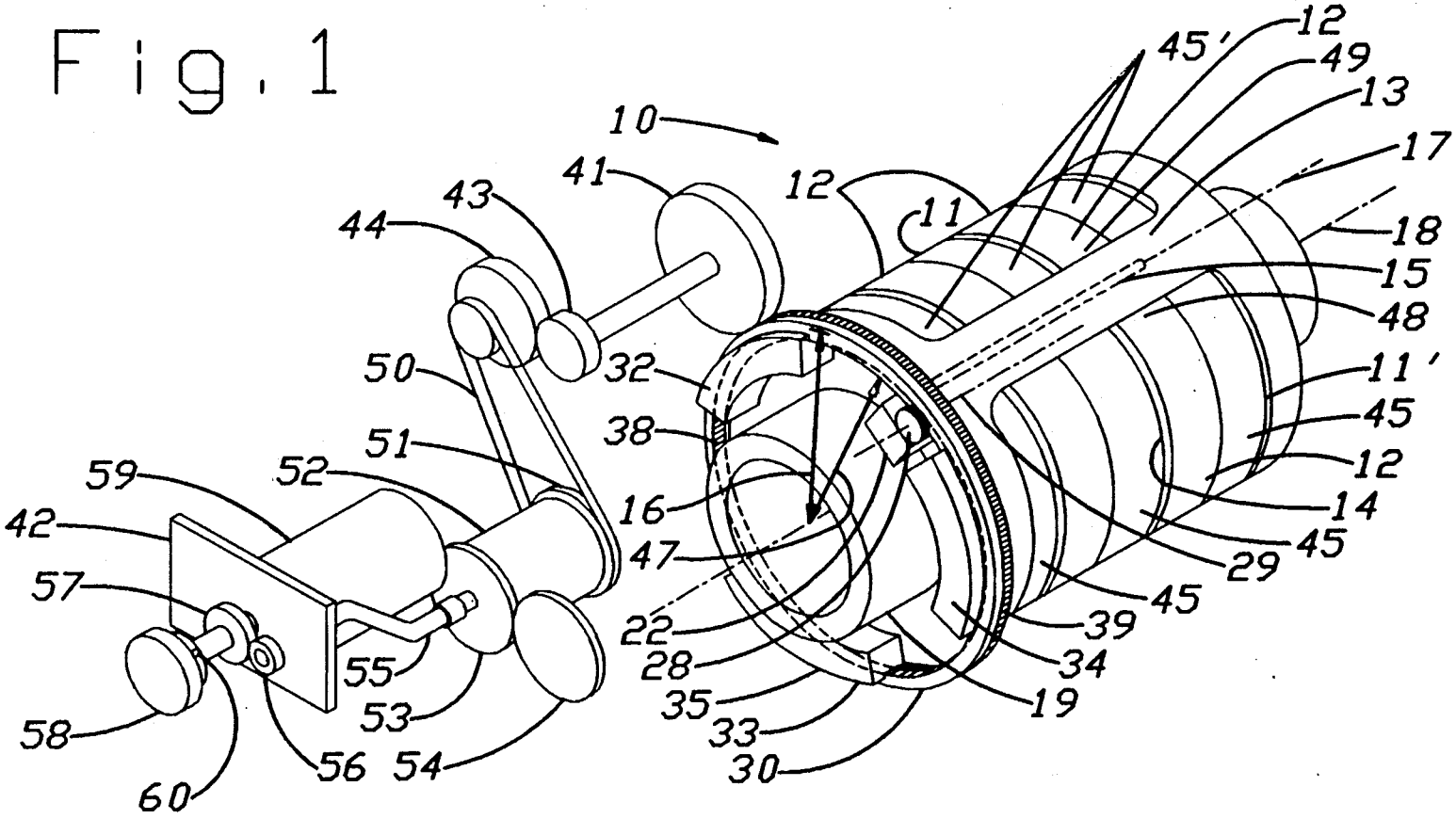
FIG. 1 is a schematic perspective view of the preferred embodiment of the dynamic expansion band adjustment mechanism for a running cylinder of the printing press of the present invention.
Figure 2:
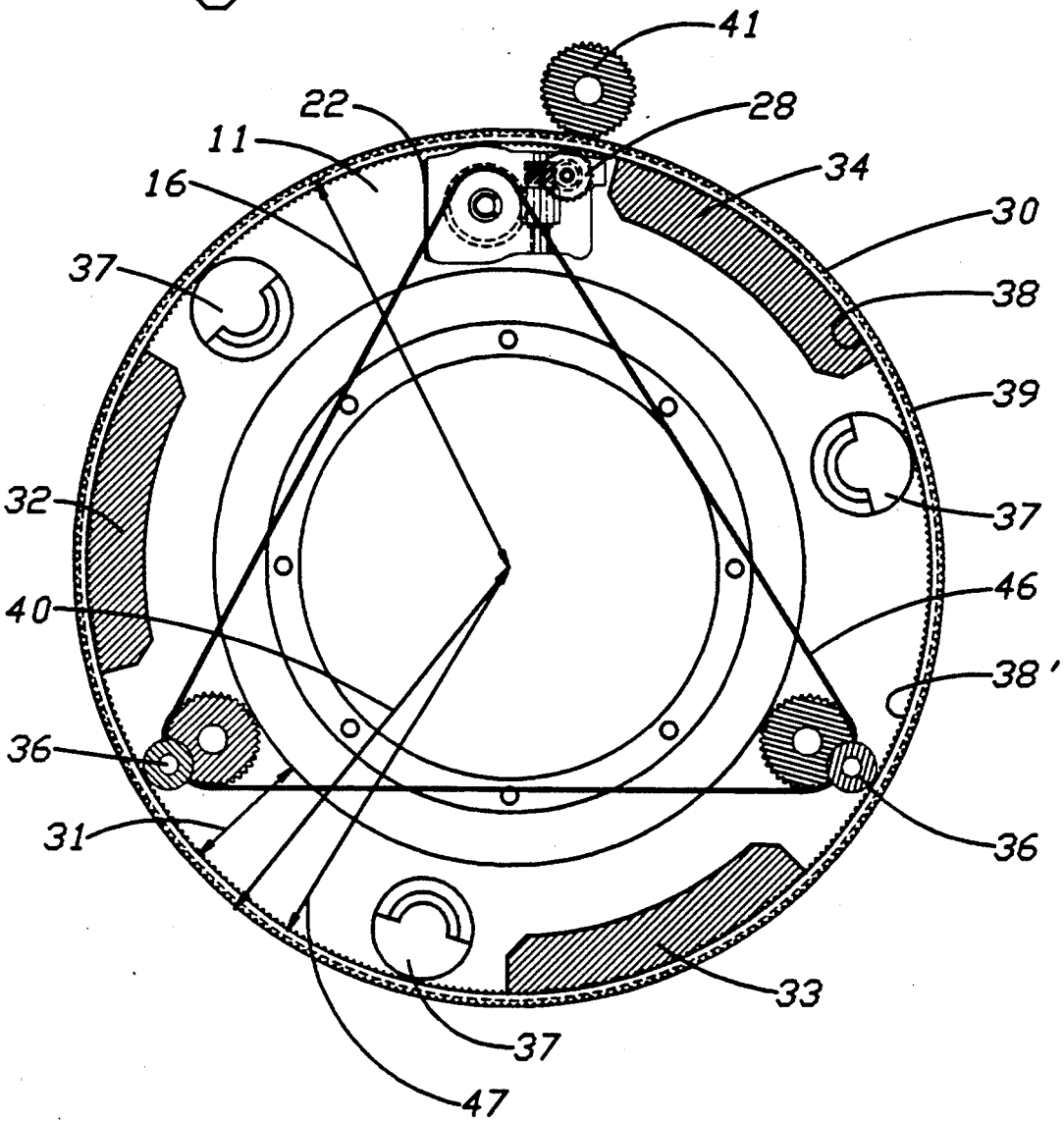
FIG. 2 is a detailed end view of the running cylinder of the invention showing an adjusting ring gear of the dynamic expansion band adjustment mechanism of FIG. 1 and a band box.
Figure 6:
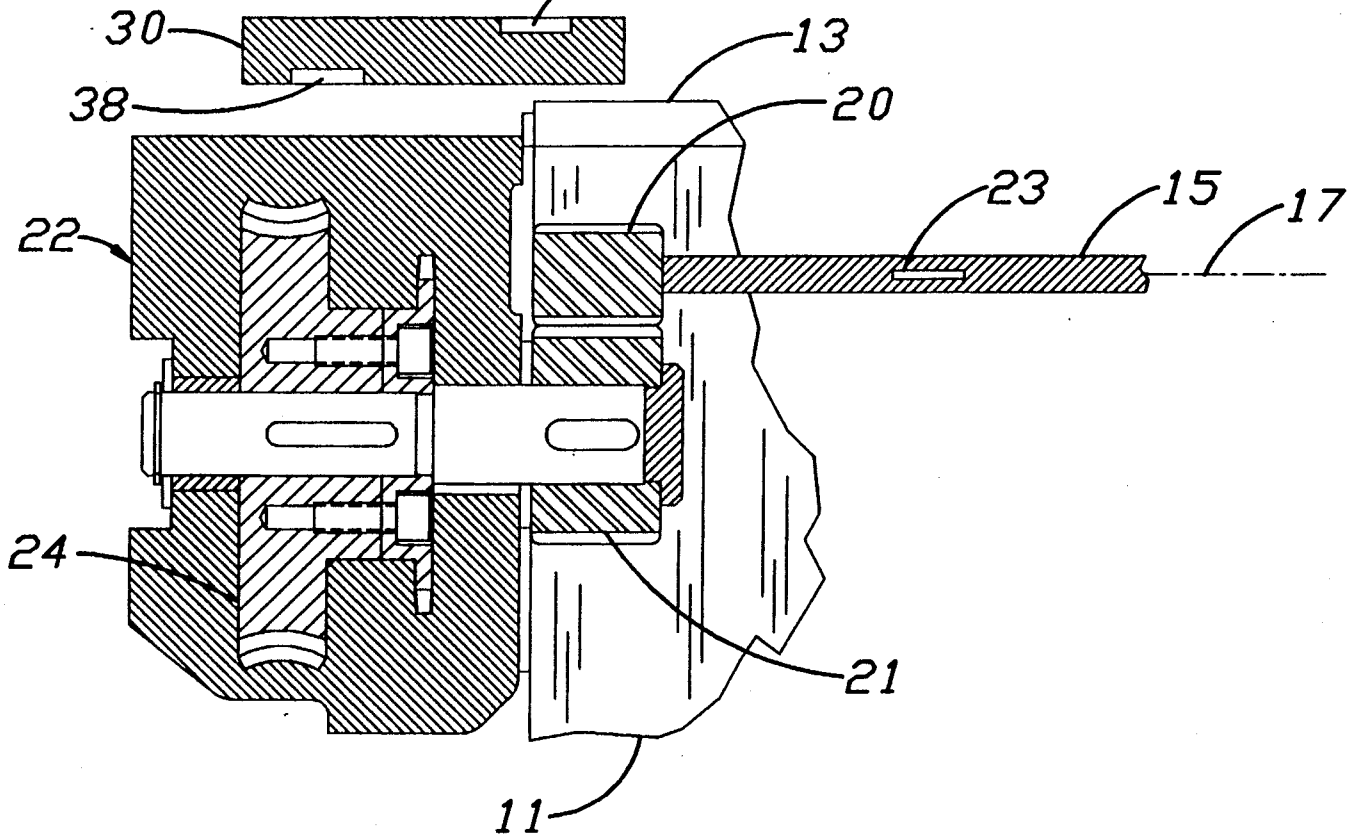
FIG. 6 is an end side view of the band box as seen along line VI—VI of FIG. 5.

Referring to FIG. 1, the preferred embodiment of the dynamic expansion band mechanism 10 is schematically seen employed in a running cylinder 11 of a printing press. The running cylinder 11 has a relatively thin cylindrical wall 11' with cylindrical inside and outside surfaces mounted for rotation upon cylindrical journal 19. Three sets of at least two elongate, expansion bands 12 are respectively mounted within three openings 45, 45' and a third not shown. Each set of expansion bands 12 is linked with an associated slide bar 15 under the wall 11'. The three slide bars 15 are interconnected to a single band box 22 by a chain 46, FIG. 2, within the running cylinder 11 to move all three sets of expansion bands in unison. The curved expansion bands 12 are resiliently flexible for deflection from below the surface 13 of the running cylinder to above the surface of the running cylinder 11, to decrease and increase, respectively, the effective average radius and circumference of the running cylinder. The interior sides 14 of the expansion bands 12 are connected to a slide bar 15 by means of intermediate components (not shown) which cause the adjacent end 48 of the bands to move longitudinally toward and away from the distal ends 49 when the side bar 15 moves back and forth. The distal ends 49 are fixedly mounted to the surface 13 of the running cylinder 11 while the adjacent ends 48 are mounted for sliding movement toward the distal ends. Referring now to FIGS. 1 and 2, slide bar 15 is within the outer diameter 16 of the running cylinder 11 and has a longitudinal axis 17 aligned parallel to the axis of rotation 18 of the running cylinder 11. As best shown in FIG. 6, slide bar 15 envelopes a slide bar screw (not shown) within and integral with a slide bar screw 20 that engages a slide bar adjustment gear 21 mounted to band box 22. The rotation of the slide bar adjustment gear 21 causes slide bar 15 to slide along its longitudinal axis 17. Ramp slits 23 in the slide bar 15 cause the expansion bands 12, FIG. 1, to deflect above the surface 13 of the running cylinder 11 against pressure from the paper product (not shown) using a cam follower and suitable slidable mounting mechanisms which are well known and form no part of this invention.

Figure 4:
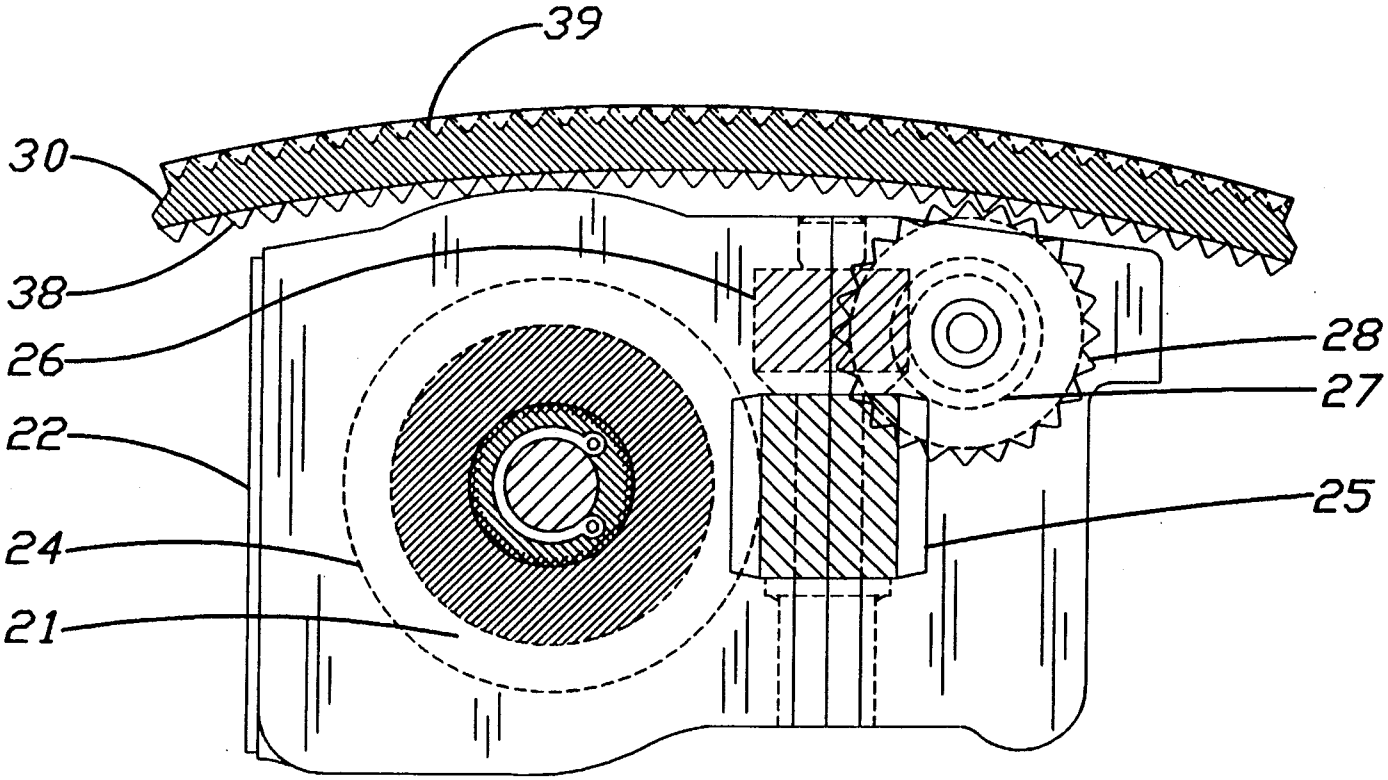
FIG. 4 is a detailed front side view of the band box shown schematically in FIG. 1.
Figure 5:
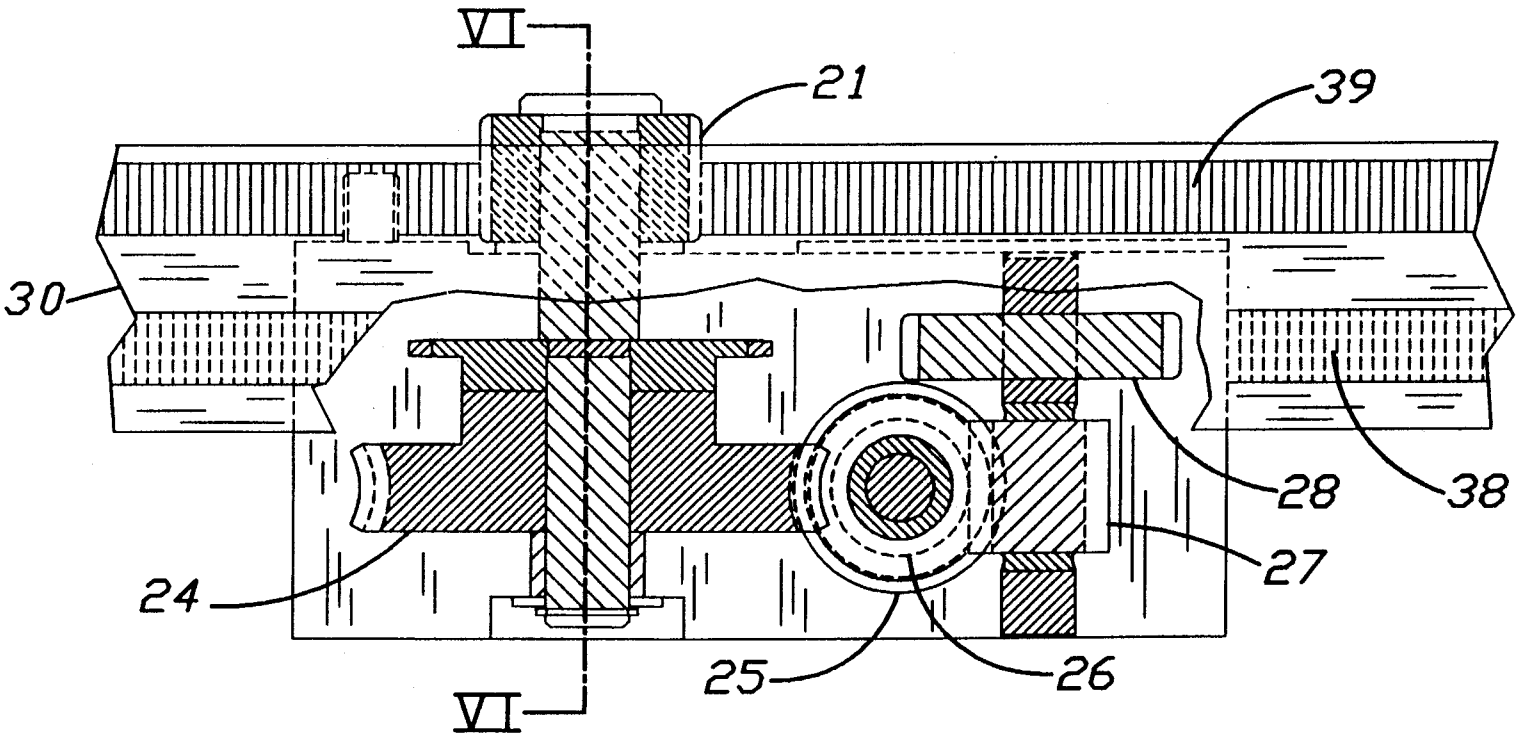
FIG. 5 is a plan view of the band box of FIG. 4.

As best seen in FIG. 5, the slide bar adjustment gear 21 is coaxially connected to a worm wheel 24. Worm wheel 24 engages worm gear 25 at a ninety degree angle. Worm gear 25 is coaxially connected to a crossed-helical gear 26 which engages another crossed-helical gear 27 at a ninety degree angle. The cross-helical gear 27 is coaxially connected to an input spur gear 28 shown in FIGS. 1, 4, 5 and 6. The co-axis of cross-helical gear 27 and input spur gear 28 is parallel to the axis of the slide bar 15. The gears 21, 24, 25, 26, 27 and 28 are mounted to the band box 22. The axis of rotation within the band box 22 is changed twice by ninety degrees and the band box 22 achieves a 7.5:1 gearing ratio between the input spur gear 28 and the slide bar adjustment gear 21 within the confined space available.

The use of multiple gears 24, 25, 26, 27 and 28 in the band box 22 avoids using a single slide bar adjustment gear 21 to directly engage the adjusting ring gear 30. It has been found that the use of a single gear instead of a multiple gear band box 22 disadvantageously requires the single gear to have a five inch diameter which is too large for the confined space of the working area 31, shown in FIG. 2. The slide bar adjustment gear 21, shown in FIGS. 5, 6 and 7, is only about 1.5 inches in diameter, and the largest gear in the band box is the worm gear 25 which is only 3.5 inches in diameter.

As seen in FIG. 2, band box 22 is mounted to the side of the running cylinder 11 at a location within the working area 31 of the running cylinder and thereby rotates with the running cylinder at exactly the same speed as the running cylinder at all times. As seen in FIG. 1, three gear tracks 32, 33 and 34 are fixedly mounted to the running cylinder 11 and form an interrupted journal 35 for the mounting of the adjusting ring gear 30. The adjusting ring gear 30 is mounted on the gear tracks 32, 33 and 34 which act as an oiled, plain bearing. Provision of the interrupted journal 35 has been found to be necessary in order to provide room for other working mechanisms of the running cylinder 11, such as more than one band adjustment stud 36 and more than one pin lever shaft 37, as shown in FIG. 2. Unlike the known dynamic adjustment mechanism, although the adjusting ring gear 30 is mounted to the running cylinder 11, advantageously this does not affect its performance, since there are no significant tolerance accumulations and access for service is possible without the need for major cylinder or frame disassembly.

The adjusting ring gear 30 rotates around the axis 18 of the running cylinder 11 at substantially the same speed as the running cylinder, except during dynamic adjustment when the adjusting ring moves slightly faster or slower, or approximately at the same speed as the running cylinder. The running cylinder 11 normally rotates at about 400 RPM. During dynamic adjustment, the adjusting ring gear 30 selectively rotates approximately one RPM faster and slower than the running cylinder 11 for a selected period of time to achieve the desired amount of adjustment. The adjusting ring gear 30 has an inner engagement surface 38 and an outer engagement surface 39. In the embodiment 10, gear teeth 38' at the inner engagement surface 38 engage the input spur gear 28 with a 330:24 ratio. Except during dynamic adjustment, there is no relative movement between the input spur gear 28 and the adjusting ring gear 30. As best seen in FIG. 2, the diameter 40 of the outer engagement surface 39 of the adjusting ring gear 30 is greater than the diameter 16 of the running cylinder 11 and engages cylinder input gear 41 at a location outside the diameter 16 of the running cylinder 11. As shown in FIG. 1, cylinder input gear 41 is mounted to the controller 42 which is stationary with respect to the running cylinder 11 and the adjusting ring gear 30.

Referring again to FIG. 1, the adjusting ring gear 30 is driven by the cylinder input gear 41. The cylinder input gear 41 is driven via intermediate gears 43 and 44 which operate in opposite directions. Intermediate gear 44 is driven via belt 50 by output 51 of differential 52 mounted to the controller 42. In the embodiment 10, the differential 52 is preferably a Harmonic Drive® HDB-32 differential with an 80:1 gear set made by Quincy Technologies of Wakefield, Mass. Input 53 and output 51 of the differential 52 are of the same diameters. Input 53 is driven by an input drive 54 from the delivery fly (not shown) which rotates at the angular speed of the running cylinder 11. Output 51 rotates at the same speed as input 53 except when differential adjustment shaft 55 and differential adjustment gears 56 and 57 are turned by either handwheel 58 or actuating motor 59.

When the differential adjustment shaft 55 is turned, output 51 selectively rotates faster or slower than input 53, depending upon the direction of rotation of the differential adjustment shaft. When output 51 rotates faster than input 53, adjusting ring gear 30 rotates faster than the running cylinder 11 to cause relative movement between the adjusting ring gear 30 and the band box 22. This relative movement, on the order of $\pm 1$ RPM, causes the input spur gear 28 to rotate and thereby rotate slide bar adjustment gear 21. Approximately two revolutions of the adjusting ring gear 30 is required to cause the expansion bands 12 to travel over their entire range. This contributes to a relatively large overall gearing ratio between the hand wheel 58 and the slide bar adjustment gear 21 of approximately 320:1, which is advantageously substantially larger than the corresponding ratio of about 80:1 in the known dynamic adjustment mechanism.

This large ratio advantageously prevents the expansion bands 12 from moving too quickly. If the expansion bands 12 move too quickly, the paper being folded will break. Moreover, the large ratio enables the use of a relatively smaller motor than would be required in the known dynamic adjustment mechanism if a motor were employed.

The large, overall gearing ratio also renders the dynamic adjustment mechanism 10 to be self-locking due to the residual torque in the motor 59 being multiplied by the large gearing ratio and enables manual operation using a handwheel 58. A detent 60, FIG. 1, in the handwheel is also preferably provided to provide additional locking.

Figure 3:
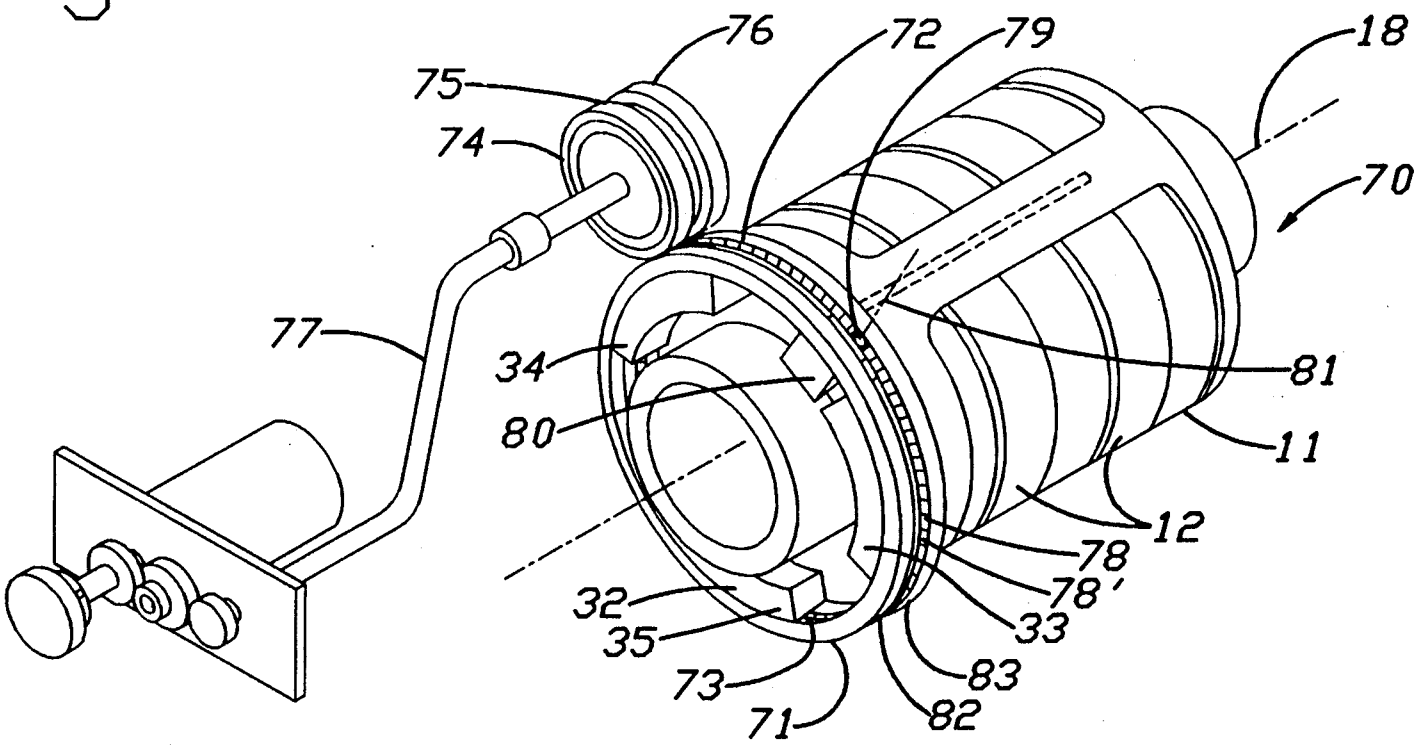
FIG. 3 is a schematic perspective view of an alternate embodiment of the dynamic expansion band adjustment mechanism of the present invention which is preferred for new applications.

Referring to FIGS. 3 and 4, the alternate embodiment of the dynamic expansion band adjustment mechanism 70 is preferred when the invention is not retrofitted but is built as part of a new printing press as opposed to the dynamic expansion band mechanism 10 of FIGS. 1 and 2 which is especially designed for retrofitting to an existing press. The alternate embodiment of the dynamic expansion band adjustment mechanism 70 in FIG. 3 uses two ring gears, a fixed ring gear 71 and a slip ring gear 72. Fixed ring gear 71 is fixedly mounted to the running cylinder 11 and, as such, rotates at the exact speed of the running cylinder 11 at all times. Slip ring gear 72 is mounted to the running cylinder 11 by means of an oiled plain bearing 73 to enable rotation at speeds other than the speed of rotation of the running cylinder 11.

Both ring gears 71 and 72 are mounted on gear tracks 32, 33 and 34 which forms an interrupted journal 35. The fixed ring gear 71 and the slip ring gear 72 also have spur teeth (not shown) their outer engagement surfaces 82 and 83, respectively. Similarly, the teeth on the differential input gear 74 and the differential output gear 76 are not shown. Differential input gear 74 is driven by fixed ring gear 71 and provides the input drive to the 1:1 differential 75. The output of the differential 75 is differential output gear 76. The differential output gear 76 normally rotates at the speed of the differential input gear 74 except when the differential adjustment shaft 77 is rotated. The differential output gear 76 drives the slip ring gear 72 thereby allowing the slip ring gear to selectively rotate faster and slower than the running cylinder 11. The slip ring gear 72 has face teeth 78' on side engagement surface 78 which engage input gear 79 mounted to band box 80. Band box 80 of the dynamic expansion band adjustment mechanism 70 of FIG. 3 is less complex than band box 22 of the preferred embodiment 10 of FIG. 1 because the axis of rotation 81 of input gear 79 differs from the axis of rotation 29 of input spur gear 28 of the preferred embodiment 10 by an angle of ninety degrees. Nevertheless, the structure, function and operation of band box 80 is substantially the same as that of band box 22. In the dynamic expansion band adjustment mechanism 70, the input 74 and output 76 to the differential 75 are advantageously taken directly from the running cylinder 11.

While a detailed description of the preferred embodiment of the invention has been given, it should be appreciated that many variations can be made thereto without departing from the scope of the invention as set forth in the appended claims. For instance, while it is preferred for the adjusting ring gear 30 to be a spur gear with inner teeth and outer teeth, it is also contemplated to use an adjusting ring member with outer spur teeth and side face teeth or any other combination of teeth on two surfaces.

I claim:

1. In a printing press having a running cylinder with a rotary axis, an outer diameter and expansion bands for changing the effective outer diameter of the running cylinder, the improvement being a dynamic expansion band adjustment mechanism for moving the expansion bands while the running cylinder is rotating about the rotary axis, comprising:

a cylinder adjusting member having an inner surface with an inner diameter and an outer surface with an outer diameter mounted for rotation about the rotary axis of the running cylinder, the inner diameter of the cylindrical adjusting member being substantially the same as the outer diameter of the running cylinder;

means mounted to the running cylinder at a location within the inner diameter of the cylindrical adjusting member for adjusting the expansion bands in response to relative rotary movement between the cylindrical adjusting member and the running cylinder; and means including a member located without the other diameter of the running cylinder and engageable with the outer surface of the cylindrical adjusting member for rotating the cylindrical adjusting member about the rotary axis relative to the running cylinder.

2. The printing press of claim 1 in which the cylindrical adjusting member is a gear with inner and outer teeth at said inner and outer surfaces, respectively.

3. The printing press of claim 1 in which the adjusting means includes a member mounted for rotation with the running cylinder.

4. The printing press of claim 1 in which the running cylinder rotates at a preselected speed, and the cylindrical adjusting member rotates at a speed approximately equal to said preselected speed.

5. The printing press of claim 1 in which the rotating means is stationary relative to the running cylinder and cylindrical adjusting member.

6. The printing press of claim 5 in which the rotating means includes a differential gear.

7. In a printing press having a running cylinder rotatable at a preselected speed and with a rotary axis and expansion bands for changing the effective outer diameter of the running cylinder, the improvement being a dynamic expansion band adjustment mechanism for moving the expansion bands while the running cylinder is rotating about the rotary axis, comprising:

a cylindrical adjusting member with first and second engagement surfaces on different sides of the cylindrical adjusting member;

means engageable with one of the first and second engagement surfaces for rotating the cylindrical adjusting member;

another member having an engagement surface for engagement with the cylindrical adjusting member rotating means;

means for driving the other member to rotate at substantially the same speed as the running cylinder;

means including a member engaging the other of the first and second engagement surfaces for moving the expansion bands and in response to a rotational speed difference between the cylindrical adjusting member and the other member; and means for controlling the cylindrical adjusting member rotating means to produce a rotational speed difference between the cylindrical adjusting member and the other member.

8. The printing press of claim 7 in which the first and second engagement surfaces are on adjacent sides of the cylindrical adjusting member.

9. The printing press of claim 8 in which the cylindrical adjusting member includes a ring gear with side face teeth for engaging the expansion band moving means.

10. The printing press of claim 7 in which the first and second engagement surfaces are on opposite sides of the cylindrical adjusting member.

11. The printing press of claim 10 in which the cylindrical adjusting member includes a ring gear with inner spur teeth for engaging the expansion band moving means.

12. The printing press of claim 7 including means for driving the cylindrical adjusting member to rotate at a speed approximately equal to the preselected speed of the running cylinder.

13. The printing press of claim 7 in which the cylindrical adjusting member rotates about the rotary axis of the running cylinder.

14. The printing press of claim 7 in which of outside engagement surface of the cylindrical adjusting member is greater than the effective outer diameter of the running cylinder.

15. The printing press of claim 7 including means for mounting the cylindrical adjusting member to the running cylinder.

16. In a printing press having a running cylinder with a rotary axis, a diameter and expansion bands for changing the diameter of the running cylinder, the improvement being a dynamic expansion band adjustment mechanism for moving the expansion bands while the running cylinder is rotating about the rotary axis, comprising:

a cylindrical adjusting member with an inwardly facing engagement surface;

means for mounting the cylindrical adjusting member for rotation about the rotary axis of the running cylinder;

means rotating with the running cylinder and responsive to relative rotary movement between the cylindrical adjusting member and the running cylinder for moving the expansion bands; and means for rotatably moving the cylindrical adjusting member about the rotary axis relative to the running cylinder.

17. The printing press of claim 16 in which the cylindrical adjusting member has an outwardly facing engagement surface.

18. The printing press of claim 17 in which the cylindrical adjusting member is a ring gear with inner and outer teeth.

19. The printing press of claim 16 in which the cylindrical adjusting member has a diameter which is substantially equal the diameter of the running cylinder.

20. The printing press of claim 16 in which the expansion band moving means includes means for engaging the inwardly facing engagement surface of the cylindrical adjusting means.

21. The printing press of claim 16 including means for mounting the expansion band moving means to the running cylinder to rotate therewith.

22. The printing press of claim 16 in which the rotatably moving means includes differential gears.

23. In a printing press having a running cylinder with a diameter, an axis of rotation and expansion bands for changing the diameter of the running cylinder, the improvement being a dynamic expansion band adjustment mechanism for moving the expansion bands while the running cylinder is rotating about the rotary axis, comprising:

a cylindrical adjusting member having a plurality of engagement surfaces carried on an interrupted journal of the running cylinder for rotation about the axis of rotation of the running cylinder;

means engaging one of the engagement surfaces for rotating the cylindrical adjusting member relative to the running cylinder; and means engaging another of the engagement surfaces for moving the expansion bands of the running cylinder.

24. The printing press of claim 23 in which engagement surfaces of the cylinder adjusting member are on different sides of the cylindrical adjusting member.

25. The printing press of claim 24 in which the engagement surfaces of the cylindrical adjusting member are on adjacent sides of the cylindrical adjusting member.

26. The printing press of claim 24 in which the engagement surfaces of the cylindrical adjusting member are on opposite sides of the cylindrical adjusting member.

27. The printing press of claim 23 in which the running cylinder rotates at a preselected speed, and the cylindrical adjusting member rotates at a speed approximately equal to said preselected speed.

28. The printing press of claim 23 in which the cylindrical adjusting member has an inner diameter and an outer diameter, the outer diameter being larger than the diameter of the running cylinder.

29. In a printing press having a running cylinder with a diameter rotatable at a preselected speed with expansion bands for changing the diameter of the running cylinder, the improvement being a dynamic expansion band adjustment mechanism for moving the expansion bands while the running cylinder is rotating about the rotary axis, comprising:

a cylindrical adjusting member having a plurality of engagement surfaces;

a differential engages with one of the plurality of engagement surfaces;

a cylindrical member having an outer engagement surface for engagement with the differential;

means for driving the cylindrical member to rotate at a speed substantially equal to the preselected speed of the running cylinder;

means for actuating the differential to produce a relative rotational speed difference between the cylindrical adjusting member and the cylindrical member; and means including a member engaged with another of the plurality of engagement surfaces of the cylindrical adjusting member for moving the expansion bands in response to the rotational speed difference between the cylindrical adjusting member and the cylindrical member.

30. The printing press of claim 29 in which the cylindrical adjusting member rotates about the rotary axis of the running cylinder.

31. The printing press of claim 29 in which the cylindrical adjusting member is mounted on an interrupted journal.

32. The printing press of claim 29 in which the cylindrical member is mounted on an interrupted journal.

33. The printing press of claim 29 in which the cylindrical adjusting member has an inner engagement surface and an outer engagement surface.

34. The printing press of claim 29 in which the cylindrical adjusting member has an outer side with an outer engagement surface and another side adjacent to the outer side with another engagement surface.

35. The printing press of claim 29 including means for driving the cylindrical adjusting member to rotate at a speed approximately equal to the preselected speed of the running cylinder.

36. The printing press of claim 29 in which the differential engages the one of the plurality of engagement surfaces of the cylindrical adjusting member at a location outside the diameter of the running cylinder.

37. The printing press of claim 29 in which the cylindrical adjusting member has an outer diameter larger than the diameter of the running cylinder.

38. The printing press of claim 29 in which the actuating means is stationary with respect to the running cylinder, the cylindrical member and the cylindrical adjusting member.

39. In a printing press having a running cylinder with an outer diameter for rotation about a rotary axis at a preselected speed and expansion bands for changing the effective outer diameter of the running cylinder, the improvement being a dynamic expansion band adjustment mechanism, comprising:

means for selectively adjusting the expansion bands while the running cylinder is rotating; and means for automatically locking the expansion bands adjustment selected by the selectively adjusting means.

40. The printing press of claim 39 in which the selectively adjusting means is stationary with respect to the running cylinder.

41. The printing press of claim 39 including a cylindrical adjusting member mounted for rotation about the rotary axis;

means for rotating the cylindrical adjusting member about the rotary axis; and means for moving the expansion bands in response to relative rotational movement between the cylindrical adjusting member and the running cylinder.

42. The printing press of claim 41 in which the locking means comprises the rotating means and the moving means.

43. The printing press of claim 41 in which the cylindrical adjusting member rotates at approximately the speed of the running cylinder.

44. The printing press of claim 41 in which the rotating means is stationary with respect to the running cylinder.

45. The printing press of claim 41 in which the moving means rotates at the speed of the running cylinder.

46. The printing press of claim 39 in which the locking means maintains the expansion band adjustment against radial force toward the rotary axis.

47. The printing press of claim 41 in which the rotating means engages the cylindrical adjusting member at a location outside the outer diameter of the running cylinder.

* * * * *